United States Patent [19]

Hutchins

[11] 4,440,446

[45] Apr. 3, 1984

[54] METHOD FOR FORMING A MODULE OF IN SITU OIL SHALE RETORTS

[75] Inventor: Ned M. Hutchins, Grand Junction, Colo.

[73] Assignee: Occidental Oil Shale, Inc., Grand Junction, Colo.

[21] Appl. No.: 338,896

[22] Filed: Jan. 12, 1982

[51] Int. Cl.[3] ..... E21C 41/10

[52] U.S. Cl. ..... 299/2; 299/13; 102/312

[58] Field of Search ..... 299/2, 13, 11, 19; 166/299; 102/311, 312

[56] References Cited

U.S. PATENT DOCUMENTS

| | | | |
|---|---|---|---|
| 1,842,664 | 1/1932 | Elsing | 299/13 |
| 4,106,814 | 8/1978 | French | 299/2 |
| 4,194,788 | 3/1980 | Miller | 299/2 |

OTHER PUBLICATIONS

"Large Scale Experimentation in Oil Shale," by P. G. Zambas, et al., Society of Mining Engineers, *AIME Transactions, vol. 252,* Sep. 1972, pp. 283–289.

*Primary Examiner*—Ernest R. Purser
*Assistant Examiner*—Hoang C. Dang
*Attorney, Agent, or Firm*—Christie, Parker & Hale

[57] ABSTRACT

A module of in situ oil shale retorts are formed in a row of retort sites in a subterranean formation. Each retort has top, bottom, and side boundaries of unfragmented formation and contains a fragmented permeable mass of formation particles. Two cross drifts are excavated through the retort sites along the row. One of the drifts is at a lower elevation near the floor of voids to be formed in the retort sites and along one side boundary of the retort sites. The other drift ramps upwardly at an end of the row for extending through the retort sites at a higher elevation near the roof of the voids excavated in the retort sites and along the opposite side boundaries of the retort sites. A horizontally extending slice is excavated at the elevation of the higher drift extending substantially to the side boundaries of a retort site for commencing a void within the retort site. The balance of the void is formed by benching from the slice to the elevation of the lower drift. This leaves at least one zone of unfragmented formation remaining in the retort site with a horizontally extending free face adjacent to the void. Such a zone of formation is explosively expanded toward the void for forming a fragmented permeable mass of formation particles in the retort.

17 Claims, 6 Drawing Figures

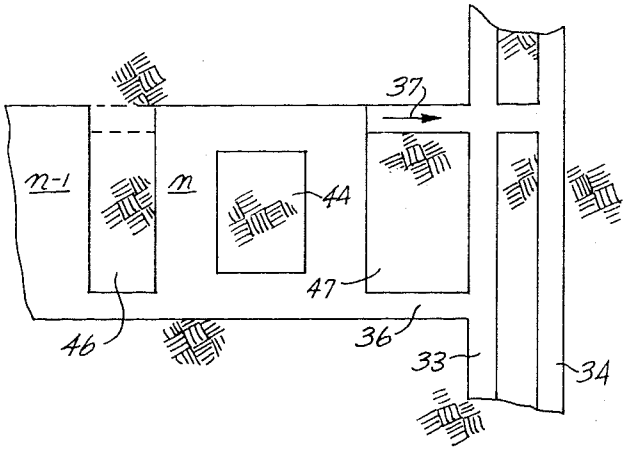
FIG. 5
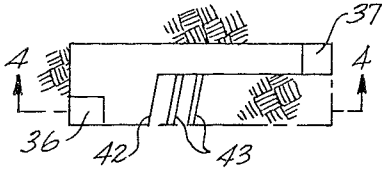
FIG. 4
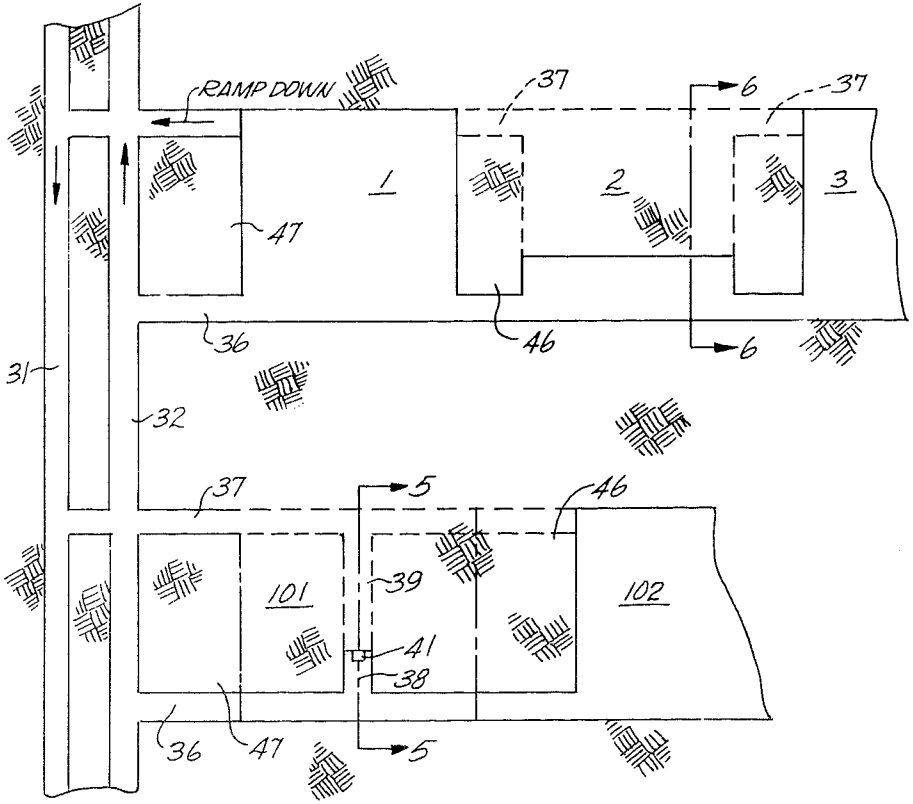

METHOD FOR FORMING A MODULE OF IN SITU OIL SHALE RETORTS

BACKGROUND OF THE INVENTION

1. Field of the Invention

This invention relates to in situ recovery of shale oil, and more particularly to techniques for forming a row of in situ oil shale retorts, which can be operated as a module.

2. Descriptiposits. The term "oil shale" as used in the industry is in fact a misnomer; oil shale is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597; 4,043,598; and 4,238,136, which are incorporated herein by this reference. These patents describe in situ recovery of liquid and gaseous hydrocarbon materials from a subterranean formation containing oil shale, wherein such formation is explosively expanded for forming a fragmented permeable mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the fragmented mass. In the combustion zone, oxygen from a retort inlet mixture is depleted by reaction with hot carbonaceous material in the oil shale to produce heat, combustion gas and combusted oil shale. By continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, and a residual solid carbonaceous material. The residual carbonaceous material provides most of the fuel for the combustion zone as it advances through the fragmented mass.

The liquid and gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process.

An in situ oil shale retort can be formed by excavating one or more generally horizontally extending voids within the boundaries of a retort site. One or more zones of unfragmented formation remain in the retort site, each with a horizontally extending free face adjacent to such a void. Explosive charges are placed in such a remaining zone of unfragmented formation for explosively expanding the formation towards such a void. This forms fragmented permeable mass of formation particles in the retort. According to some techniques for forming an in situ oil shale retort, such a void in the retort site can be thirty to sixty or more feet high. Such voids can be 100 to 200 feet across or in some cases, even longer in one direction. During development of a large oil shale tract dozens of such voids can be in various stages of excavation at a given time. It is desirable to provide fast and economical techniques for excavating such large voids.

It is sometimes desirable to form in situ oil shale retorts in one or more rowe to provide modules of retorts that can be processed at substantially the same time. By operating retorts in modules or groups, economical control can be facilitated. Liquid and gaseous products withdrawn from all of the retorts in the module can be commingled thereby minimizing separate facilities needed for handling the products of retorting. Entire modules of retorts rather than individual retorts can be isolated from other underground workings for avoiding spread of noxious or toxic gases through such underground workings.

U.S. Pat. No. 4,106,814 describes a technique for forming a row of horizontally spaced apart in situ oil shale retorts. Retort access cross drifts are excavated through a plurality of retorts in such a row. Each retort is formed by excavating horizontal voids at the elevations of the retort access drifts. Each retort is then formed by explosively expanding formation within the boundaries of such a retort site towards such voids for forming a fragmented permeable mass of formation particles in each retort. In one embodiment described in this patent, the cross drifts through the retorts are about 20 feet high and the corresponding horizontal voids are excavated to about the same height. Since some embodiments of techniques for forming in situ oil shale retorts employ considerably higher voids, it is desirable to provide techniques for economically excavating such high voids in a row or module of retorts.

BRIEF SUMMARY OF THE INVENTION

There is, therefore, provided in practice of this invention according to a presently preferred embodiment a method for forming a module of in situ oil shale retorts in a row of retort sites in a subterranean formation. Each retort has top, bottom, and side boundaries of unfragmented formation and contains a fragmented permeable mass of formation particles. Two cross drifts are excavated through the retort sites along the row. One of the drifts is at a lower elevation near the floor of voids to be formed in the retort sites. The other drift ramps upwardly at an end of the row for extending through the retort sites at a higher elevation near the roof of the voids excavated in the retort sites. A horizontally extending slice is excavated at the elevation of the higher drift extending substantially to the side boundaries of a retort site for commencing a void within the retort site. The balance of the void is formed by benching from the slice to the elevation of the lower drift. This leaves at least one zone of unfragmented formation remaining in the retort site with a horizontally extending free face adjacent to the void. Such a zone of formation is explosively expanded toward the void for forming a fragmented permeable mass of formation particles in the retort.

DRAWINGS

These and other features and advantages of the present invention will be appreciated as the same becomes better understood by reference to the following detailed description when considered in connection with the accompanying drawings wherein:

FIG. 4 is a semi-schematic horizontal cross section, looking upwardly, through a plurality of in situ oil shale retorts at a variety of intermediate stages of forming such retorts;

FIG. 6 is a fragmentary vertical cross section of another such retort site at line 6—6 in FIG. 4.

DESCRIPTION

Figure 1:
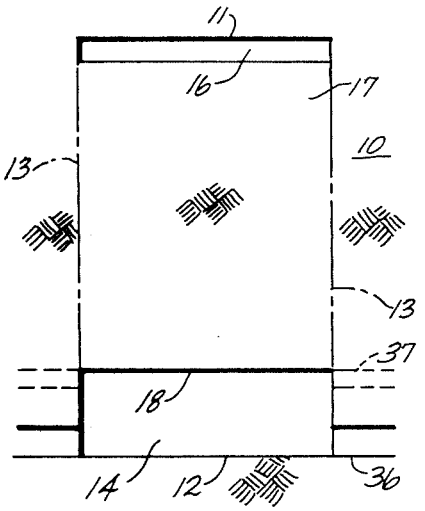
FIG. 1 is a semi-schematic vertical cross section of an in situ oil shale retort site in an intermediate stage of forming an in situ oil shale retort.
Figure 2:
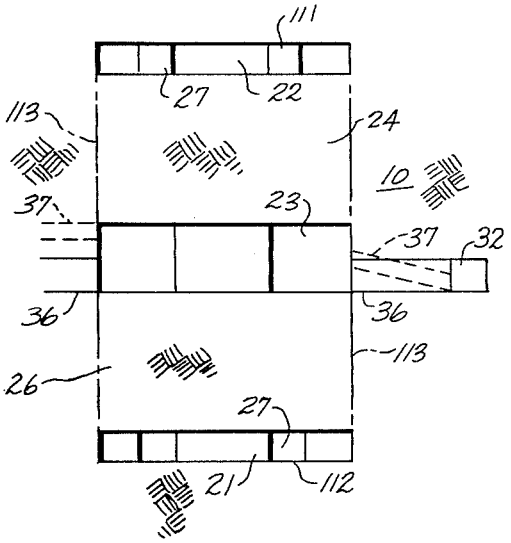
FIG. 2 is a semi-schematic vertical cross section of another embodiment of a technique for forming an in situ oil shale retort, also in an intermediate stage of development.

Techniques for forming a module of in situ oil shale retorts in practice of principles of this invention can be used with a variety of embodiments of such retorts FIGS. 1 and 2 illustrate in vertical cross section two such embodiments of in situ retorts at an intermediate state of development. A variety of other embodiments of retorts suitable for practice of this invention will be apparent.

In the embodiment illustrated in FIG. 1, a retort site in a subterranean formation 10 containing oil shale has a top boundary 11, a bottom boundary 12, and vertically extending side boundaries 13. A horizontally extending lower void 14 is excavated adjacent to the bottom boundary of the retort site, extending substantially to the side boundaries 13. A horizontally extending upper level void 16 is excavated adjacent to the top boundary 11 and extending to the side boundaries of the retort site. This leaves an intervening zone 17 of unfragmented formation between the lower level void 14 and upper level void 16. An ignition level or air level void can be provided above the top boundary, but is not illustrated in the drawings. The lower level void can sometimes be referred to as a production level void.

After the voids are excavated, explosive charges are placed in the intervening zone 17 and detonated for explosively expanding formation towards the upper and lower voids. In such an embodiment the intervening zone is explosively expanded in layers or lifts commencing at the horizontally extending free face 18 of the intervening zone at the roof of the lower level void. Explosive expansion of such layers progresses upwardly and an upper portion of the intervening zone 17 is explosively expanded both downwardly toward the lower level void 14 and upwardly toward the upper level void 16.

Techniques for forming an in situ oil shale retort by explosive expansion in lifts are described in U. S. Patent applications, Ser. No. 246,232 entitled "TWO-LEVEL HORIZONTAL FREE FACE MINING SYSTEM FOR IN SITU OIL SHALE RETORTS" filed March 23, 1981, by Chang Yul Cha, and Ser. No. 234,014 entitled "MINING SYSTEM FOR IN SITU OIL SHALE RETORTS" filed Feb. 12, 1981, by William D. Langford, now U.S. Pat. No. 4,349,227. Both of these applications are assigned to Occidental Oil Shale, Inc., assignee of this application and are hereby incorporated by reference.

Figure 3:
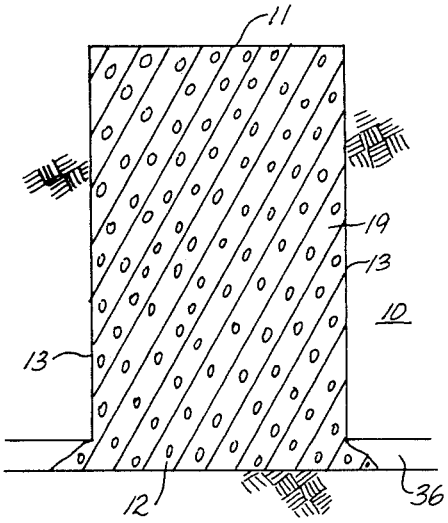
FIG. 3 is a semi-schematic vertical cross section of an in situ oil shale retort after explosive expansion.

FIG. 3 illustrates such an in situ oil shale retort after explosive expansion of the remaining zone of unfragmented formation toward the void or voids in the retort site. The retort has top 11, bottom 12, and side 13 boundaries of unfragmented formation and contains a fragmented permeable mass 19 of formation particles containing oil shale. As pointed out above, oil shale in the fragmented mass can be retorted by establishing a combustion zone in an upper portion of the fragmented mass and introducing an oxygen-supplying retort inlet mixture for sustaining the combustion zone and advancing it downwardly through the fragmented mass. A retorting zone is advanced on the advancing side of the combustion zone by reason of hot combustion gases and the like passing through the fragmented mass on the advancing side of the combustion zone. Liquid and gaseous products formed in the retorting zone are withdrawn from a lower portion of the in situ retort.

In an exemplary embodiment a retort as illustrated in FIG. 1 can be about 165 feet square and about 270 feet high. The upper level void 16 can be about 10 to 15 feet high and the lower level void can be 50 to 60 feet or more in height. The height of the voids depends on a number of factors such as the head room required for blasthole drilling equipment in the upper level void, the void fraction desired in the fragmented mass, and the presence of pillars, if any in the voids. Such pillars of unfragmented formation can be left in a void for temporarily supporting overlying formation and explosively expanded at about the same time as the zone of formation between the voids. It is desirable to economically excavate such voids, particularly the very tall lower level void. Although in the illustrated embodiment the individual retorts happen to be square in horizontal cross section, principles of this invention are applicable to long narrow retorts or to such other geometries as may be desired.

FIG. 2 illustrates another embodiment of in situ oil shale retort that can be involved in practice of this invention. As illustrated in this embodiment the retort site has a top boundary 111, a bottom boundary 112, and vertically extending side boundaries 113. A lower or production level void 21 is excavated adjacent the bottom boundary 112 of the retort being formed. An upper level void 22 is excavated adjacent the top boundary 112 of the retort site. An intermediate void 23 is excavated at an intermediate elevation between the upper and lower voids. This leaves an upper intervening zone 24 of unfragmented formation between the upper level void 22 and the intermediate level void 23. Similarly, a lower intervening zone 26 of unfragmented formation remains between the lower level void 21 and the intermediate level void 23. In the illustrated embodiment, pillars 27 of unfragmented formation are left in the excavated voids for temporarily supporting the roofs of such voids. Preferably, the voids are symmetrically arranged so that the volume of the void space in the intermediate void is equal to the combined volumes of the void spaces in the upper and lower voids.

A fragmented permeable mass of formation particles is formed in this embodiment of in situ oil shale retort by first explosively expanding the pillars 27 and then explosively expanding the upper zone 24 and lower zones 26 of formation towards the adjacent voids. Thus, the upper zone 24 is explosively expanded partly upwardly toward the overlying upper void 22 and partly downwardly toward the intermediate void 23. The lower zone 26 is explosively expanded partly upwardly toward the intermediate void 23 and partly downwardly toward the lower level void 21. Such explosive expansion of the pillars and the zones of formation between the excavated voids produces a fragmented permeable mass of formation particles similar to that mentioned above with respect to FIG. 3.

In an exemplary embodiment, such an in situ oil shale retort can have a rectangular horizontal cross section 155 feet wide and 380 feet long, and a height of 300 to 400 feet. In an exemplary embodiment the upper and lower level voids can each be about 20 feet high and the intermediate void about 43 feet high. The intermediate void can be somewhat higher than the total height of the upper and lower voids when the extraction ratio of the upper and lower voids is somewhat larger than the extraction ratio of the intermediate void due to differing pillar configurations.

A number of techniques for forming an in situ oil shale retort with multiple horizontally extending voids are known. Such techniques are described, for example, in U.S. Pat. Nos. 4,043,597; 4,043,598; 4,106,814; 4,146,272; and 4,192,554.

FIG. 4 is a semi-schematic horizontal cross section of a fragment of a tract of in situ oil shale retorts under development. Such a horizontal cross section could be taken, for example at the elevation of the lower level void 14 of an embodiment as illustrated in FIG. 1 or the elevation of an intermediate level void 23 in an embodiment as illustrated in FIG. 2.

A pair of retort access drifts 31 and 32 are excavated through the oil shale tract for providing access to a plurality of modules of in situ oil shale retorts. Circulating air flow can be provided through this double entry drift system in a conventional manner as indicated by the arrows in FIG. 4. Rows or modules of in situ retorts can be formed on one or both sides of the pair of retort access drifts. Portions of two such rows of retorts are illustrated on one side of the retort access drifts 31 and 32. Similarly at the opposite end of the modules of retorts, a second pair of retort access drifts 33 and 34 are excavated. Ordinarily, such retort access drifts are excavated through the tract as a preliminary step before formation of such in situ oil shale retorts.

A lower level cross drift 36 is excavated between the retort access drifts 32 and 33 at opposite ends of an exemplary module of retorts and extending through the sites of the retorts in the module. The lower level cross drift 36 is excavated at about the elevation of the floor of the voids excavated for forming the retorts in the row. It can be desirable to excavate such a cross drift through the entire row of retorts before extensive additional excavations are made for providing clear access for excavation equipment and for circulation of air for ventilation.

An upper level cross drift 37 is also excavated through the row of retort sites between the retort access drifts 32 and 33 at the ends of the row. The upper level cross drift is ramped upwardly at each end from the respective retort access drift until the roof of the cross drift is at about the elevation of the roof of the voids to be excavated in such retort sites. The upper level cross drift then extends through the module of retorts at the upper elevation. The ramp from the retort access drift at one or both ends of the module can be rather steep since mining equipment can be assisted up the ramp with tracked vehicles or winches and then left at the upper elevation until excavation of the module is completed. Preferably, a portion of the ramp can be within an excavated void at an end of the module for providing a moderate grade for ease of movement of equipment. Otherwise the pillar between the end retort in the row and the retort access drift must be excessively wide or the grade of the ramp must be excessively steep.

An exemplary module of retorts comprises a row of n retorts where n may be, for example, about four to ten retorts in each row. One or two such rows can be processed together as a module. Exemplary retort sites in one module in FIG. 4 are numbered sequentially from 1 to n and corresponding retort sites in a second module are numbered 101 et seq. The exemplary retorts are illustrated as square in horizontal cross section, however, it will be apparent that the techniques described herein are equally applicable for rectangular retorts with a variety of length to width ratios.

The lower level cross drift 36 is excavated through the module of retort sites 1 to n adjacent to one side boundary of each of the retort sites. The upper level cross drift 37 is excavated through the module adjacent to the opposite side boundaries of the retorts in the module. The cross drifts can be excavated sequentially or simultaneously as may be convenient.

The voids are excavated in the respective retort sites by way of the upper and lower cross drifts. Excavation of the voids can commence before such cross drifts are completed, however, completion of the cross drifts before there is extensive additional excavation along the row is usually convenient for ease of materials handling and ventilation.

Figure 5:
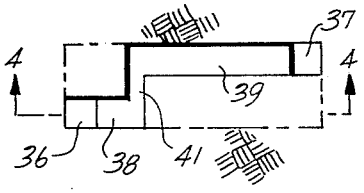
FIG. 5 is a fragmentary vertical cross section through one such retort site at line 5—5 in FIG. 4.

An initial stage of excavating a void in an in situ oil shale retort site is illustrated in retort 101 in FIG. 4 and the schematic vertical cross section of FIG. 5. This is but one example of techniques for commencing excavation of a void. A short stub 38 is excavated laterally from the lower level cross drift 36. The stub serves as a temporary bin for receiving excavated formation which is then removed by way of the lower level cross drift. A drift 39 is excavated in the retort site laterally from the upper level cross drift 37 to a location above the stub 38. A raise or winze 41 is excavated between the upper level drift 39 and the stub to enhance ventilation and provide a chute for passing excavated formation or "muck" from the upper level of the void being excavated to the stub for economical haulage. Most of the formation excavated at the upper level is dumped to the lower level where large scale equipment can be used for economically removing the excavated formation via the lower level cross drift and retort access drifts to above ground. The muck raise can be near a corner of the retort, rather than the central position illustrated in FIG. 4, or any other convenient location suitable for avoiding pillars left in the excavated voids and for facilitating excavation of the upper part of the void. Muck passes outside the boundaries of the retorts can also be used, if desired.

A horizontally extending slice is excavated from the upper level drifts adjacent to the roof of the void being formed in the retort site. The slice extends to the side boundaries of the retort site indicated by phantom lines in FIG. 4. The slice preferably has no more height than needed accommodate the mining and drilling equipment used for excavating the void being formed. It is convenient to install rock bolts or other roof supporting measures as the slice is excavated since access is easier than it would be if the full height of the void were excavated.

A vertical slot (not shown) is opened between the upper level slice and the lower level cross drift, i.e., from the floor of the slice to the floor of the void being formed. Such a slot can be opened by breaking through the roof of the lower level cross drift or by enlarging the chute 41. Once a slot is opened, formation between the floor of the upper level slice and the floor of the void being formed is excavated by benching. Such a benching operation is indicated in the retort site labeled 2 in FIG. 4 and in the vertical cross section of FIG. 6. Benching could be thought of as continual enlarging of the slot until it extends to the full side boundaries of the void being formed. As benching proceeds, a more or less vertical free face or wall 42 remains on unfragmented formation in the void being excavated. Rows of vertically extending blast holes 43 are drilled from the top of the bench to the elevation of the floor of the void, i.e., from the slice parallel to the free face 42. Explosive charges are placed in these blast holes and detonated for explosively expanding the formation between the blastholes and the free face towards the vertically extending free face. The resultant fragmented formation is then excavated by way of the lower level cross drift 36.

Preferably a minor portion of the formation excavated for forming each void is excavated from the upper level slice and a major portion is excavated by benching. This tends to reduce the mining costs for a major portion of the excavated formation. It also means that a major portion of the formation is excavated via the lower level drifts thereby permitting concentration of heavy duty earth moving equipment at the lower level.

Excavation of the slice proceeds by generally horizontal drilling and blasting in the manner of heading rounds. A substantial amount of drilling can be required for good distribution of explosive in heading rounds with consequent cost penalties. Good fragmentation can be readily obtained by benching at appreciably lower cost.

For such reasons it can be desirable to minimize the height of the slice and maximize the height of the bench. Thus, for example, the height of a slice for forming a 50 foot high void can be 12 to 15 feet and the height of the bench can be 35 to 38 feet. Under some conditions it can be desirable to use a somewhat taller slice than might be barely sufficient to accommodate equipment for drilling the vertical blast holes. A taller slice can permit a larger volume of formation to be fragmented in each heading round as the slice is enlarged.

A large number of variations in the sequence and arrangement for excavating the slice and bench can be practiced. For example, only a portion of the slice may be excavated before benching is commenced, or if preferred the entire slice can be excavated before any benching. The slice can be excavated laterally from a single central drift 39 as illustrated in Retort 101, which is convenient since excavation can proceed on opposite sides of the drift more or less simultaneously. If desired, such a drift can be made adjacent to one side boundary of the retort site or the slice can be excavated more directly from the upper level cross drift 37 without forming an additional drift. In such an embodiment formation excavated from one void can be hauled to another void for dumping to the lower level.

Benching need not proceed with the vertical wall 42 parallel to the lower level drift, if desired. A slot can be formed more or less perpendicular to the cross drift with benching towards such a slot. Many other arrangements for maximizing drilling efficiency, minimizing haulage distances, maximizing the quantity of rock fragmented per round, or minimizing disruption of operations in adjacent workings will be apparent to one skilled in the art.

Preferably the excavation of the benches in the retort sites is at least in part in a retreating mode toward one of the retort access drifts. In a retreating mode of mining, a drift or the like is extended to the furthest extent of the work to be done. Excavations are then made commencing at the far end of the drift and progressing back toward the origin. When forming a row of retorts, some of the bench should be left in retorts nearer an end of the row to permit withdrawal of drilling and/or mining equipment via the upper level cross drift at the end of the row.

The vertically extending free face 42 on the bench can be substantially vertical if desired or can slope somewhat as suggested in FIG. 6. The latter arrangement can be desirable for safety and the former can be desirable for assuring good fragmentation at the toe of the bench in the last benching round.

Thus, a void is provided in each retort site at the completion of the slicing and benching operations. Such a void can be completely open for the full span of the void as illustrated in Retort 1 in FIG. 4. Alternatively, if desired, such a void can include one or more pillars 44 for temporarily supporting the roof of the void as illustrated in Retort n in FIG. 4. A single rectangular pillar can be left as illustrated in FIG. 4 or other patterns can be used. For example, a pair of long parallel pillars can be left in a void or four square pillars can be left in each quadrant of a void. Different pillar arrangements can be used on different levels in the same retort.

Gas barriers 46 of unfragmented formation remain between adjacent retort sites. The remnants of the upper level cross drift 37 and lower level cross drift 36 extend through such pillars. Further, pillars 47 of unfragmented formation remain between the retort at each end of the row and the adjacent retort access drift. The remnants of the cross drifts 36 and 37 extend through these barrier pillars. Such barrier pillars provide support for overburden above the retort access drifts and help prevent inadvertent gas leakage from the retorts into such drifts. The gas barriers between adjacent retorts can be thin enough that they do not support substantially more of the overburden weight than the fragmented masses formed in the retorts adjacent such gas barriers.

It is preferred that the retort access drifts at each end of the module of retorts be at about the same elevation as the floors of the voids excavated in the retorts. This is desirable for avoiding large grades for earth moving equipment used for excavating formation from the voids being formed. A major portion of the formation is excavated via the lower level drifts and substantial grades are preferably avoided. Where such grades are acceptable, the retort access drifts can be at a somewhat higher elevation than the floor of the voids so that the lower level cross drift ramps downwardly toward the floor of the voids and the upper level drift ramps upwardly toward the roof of the voids. Such an embodiment can be employed, for example, where fragmented formation is hauled via conveyor belts or where the slice and bench technique is used for excavating voids at an intermediate elevation in the retorts with excavated formation dumped to a lower level via chutes or the like.

After the voids are excavated in such retort sites, explosive charges are placed in the remaining zones of unfragmented formation for explosive expansion of such formation towards the voids, thereby forming a fragmented permeable mass of formation particles in each retort. Techniques for explosive expansion as hereinabove described can be employed, along with a variety of related techniques. If desired, such retorts can be formed by explosive expansion as each void in the module is completed. This can, however, disrupt communications and ventilation and it is often preferable to defer explosive expansion until substantially all excavation in a module of retorts is completed. The retorts are then expanded sequentially for completing the module.

It can be desirable to close the drifts between adjacent retorts in the module for minimizing gas flow through the gas barriers therebetween. A seal is not required but a substantial inhibition of gas flow is often desirable. A technique for providing such a gas barrier in a drift is described in U.S. Pat. No. 4,133,580.

After all of the retorts in a module are completed, gas tight bulkheads can be erected in the cross drifts adjacent to the barrier pillars 47 for avoiding gas flow between the retorts and the retort access drifts. Any of a variety of arrangements can be employed for fluid communication to the upper and lower portions of the retorts and retorting operations can be conducted therein as hereinabove described.

In an exemplary embodiment where a tract of oil shale is being developed, at a given time retorts can be in a broad variety of stages of preparation and/or operation. For example, one or more of the cross drifts through modules of retorts can be in the process of being driven between retort access drifts. At the same time in some of the retort sites portions of the upper level slice are being excavated from upper level cross drifts. In other voids benching operations are being conducted. Both slicing and benching operations can be proceeding in other voids. In other parts of the tract retorting operations can be conducted. Such overlapping of operations can be desirable for optimizing utilization of equipment. Many such modifications and variations will be apparent to those skilled in the art. It is therefore to be understood that the scope of this invention is defined by the following claims.

What is claimed is:

1. A method for forming a plurality of in situ oil shale retorts in a row of retort sites in a subterranean formation containing oil shale, each such retort comprising top, bottom and side boundaries of unfragmented formation and containing a fragmented permeable mass of formation particles containing oil shale, comprising the steps of:

excavating a first drift at a higher elevation through the retort sites along a row of such retort sites;

excavating a second drift at a lower elevation through the retort sites along the row;

excavating an upper portion of a void in such a retort site, the upper portion extending substantially to the side boundaries and being at about the elevation of the first drift;

establishing communication between the upper portion of the void and the second drift for forming a generally vertically extending free face;

forming a plurality of generally vertically extending blastholes adjacent to the free face;

placing explosive charges in such blastholes;

detonating such explosive charges for explosively expanding formation between such blastholes and the free face toward the free face;

excavating the explosively expanded formation via the second drift for enlarging the void below the upper portion to about the elevation of the second drift and leaving a zone of unfragmented formation remaining in the retort site having a horizontally extending free face adjoining the void; and explosively expanding at least a portion of the remaining zone of formation toward the void for forming a fragmented permeable mass of formation particles containing oil shale in the in situ oil shale retort.

2. A method as recited in claim 1 further comprising the steps of:

passing at least a portion of formation excavated for forming the upper portion of the void to the lower elevation; and removing said formation from the upper portion of the void via the second drift.

3. A method as recited in claim 1 wherein a minor portion of the formation excavated for forming the void is excavated from said upper portion and a major portion of the formation excavated for forming the void is excavated via the second drift.

4. A method as recited in claim 1 wherein the first drift is adjacent to the roof of the voids being formed and the second drift is adjacent to the floor of the voids being formed.

5. A method for forming a module of in situ oil shale retorts in a row of retort sites in a subterranean formation containing oil shale, each such retort comprising top, bottom and side boundaries of unfragmented formation and containing a fragmented permeable mass of formation particles containing oil shale, comprising the steps of:

excavating at least one access drift at a first end of the module;

excavating at least one access drift at the second end of the module;

excavating a first cross drift between the access drifts and extending through the retort sites at a lower elevation;

excavating a second cross drift between the access drifts and including a ramp portion at at least one end of the second cross drift for extending through the retort sites at a higher elevation;

excavating a horizontally extending slice extending substantially to the side boundaries of such a retort site at the elevation of the second cross drift;

benching from the slice to the first drift for forming a void extending between the side boundaries and leaving at least one zone of unfragmented formation remaining in the retort site and having a horizontally extending free face adjacent to the void; and explosively expanding such a zone of formation toward the free face for forming a fragmented permeable mass of formation particles containing oil shale in the retort.

6. A method as recited in claim 5 wherein the void is excavated to leave at least one pillar of unfragmented formation in the void within the side boundaries, and further comprising the step of explosively expanding such a pillar before explosively expanding the remaining zone.

7. A method as recited in claim 5 wherein the void is adjacent to the bottom boundary of the retort site and further comprising the steps of:

excavating at least one additional void above the first void extending substantially to the side boundaries of the retort site leaving such a zone of unfragmented formation remaining between such voids; and explosively expanding such remaining zone toward both such voids.

8. A method as recited in claim 5 wherein the void is at an elevation between the top and bottom boundaries and further comprising the steps of:

excavating a second void above the first void extending substantially to the side boundaries of the retort site leaving the zone of unfragmented formation remaining between the first and second voids;

excavating a third void below the first void adjacent to the bottom boundary of the retort site and extending substantially to the side boundaries of the retort site leaving a second zone of unfragmented formation between the first and third voids;

explosively expanding the first zone of formation toward both the first and second voids; and explosively expanding the second zone of formation toward both the first and third voids.

9. A method as recited in claim 8 wherein the second void is adjacent to the top boundary of the retort site.

10. A method as recited in claim 5 wherein at least a part of such a ramp portion is excavated within the side boundaries of such a retort site.

11. A method for forming a plurality of in situ oil shale retorts in a row of retort sites in a subterranean formation containing oil shale, each such retort comprising top, bottom, and side boundaries of unfragmented formation and containing a fragmented permeable mass of formation particles containing oil shale, comprising the steps of:

excavating a first drift at a higher elevation through the retort sites along a row of such retort sites and adjacent to one side boundary of such retort sites;

excavating a second drift at a lower elevation through the retort sites along the row and adjacent to the opposite side boundary of such retort sites;

excavating a horizontally extending void extending to the side boundaries of such a retort site having a roof at about the elevation of the roof of the upper level drift and a floor at about the elevation of the floor of the lower level drift, leaving at least one zone of unfragmented formation within the retort site having a horizontally extending free face at the roof of the void; and explosively expanding such a zone of unfragmented formation toward the void for forming a fragmented permeable mass of formation particles in an in situ oil shale retort.

12. A method as recited in claim 11 wherein such a void is excavated by the steps of excavating a horizontally extending slice adjacent the roof of the void by way of access through the upper level drift and excavating a bench below the slice by way of access through both the upper level drift and lower level drift.

13. A method as recited in claim 11 wherein the void is excavated by the steps of:

establishing communication between the upper level drift and lower level drift in such a retort site;

excavating an upper portion of formation adjacent to the roof of the void from the upper level drift including passing at least a portion of excavated formation through such communication to the lower level drift; and excavating a lower portion of formation adjacent to the floor of the void through the lower level drift.

14. A method as recited in claim 11 wherein the void is excavated by the steps of:

excavating a minor portion of formation as a horizontally extending slice adjacent to the roof of the void; and excavating a major portion of formation by benching between the horizontally extending slice and the floor of the void.

15. A method for forming a plurality of in situ oil shale retorts in a row of retort sites in a subterranean formation containing oil shale, each such retort comprising top, bottom and side boundaries of unfragmented formation and containing a fragmented permeable mass of formation particles containing oil shale, comprising the steps of:

excavating a first drift at a higher elevation through the retort sites adjacent to one side boundary of such retort sites along a row of such retort sites;

excavating a second drift at a lower elevation through the retort sites adjacent to the opposite side boundary of such retort sites along the row;

excavating an upper portion of a void in such a retort site, the upper portion extending substantially to the side boundaries and being at about the elevation of the first drift;

establishing communication between the upper portion of the void and the second drift for forming a generally vertically extending free face;

forming a plurality of generally vertically extending blastholes adjacent to the free face;

placing explosive charges in such blastholes;

detonating such explosive charges for explosively expanding formation between such blastholes and the free face toward the free face;

excavating the explosively expanded formation via the second drift for enlarging the void below the upper portion to about the elevation of the second drift and leaving a zone of unfragmented formation remaining in the retort site having a horizontally extending free face adjoining the void; and explosively expanding at least a portion of the remaining zone of formation toward the void for forming a fragmented permeable mass of formation particles containing oil shale in the in situ oil shale retort.

16. A method for forming a module of in situ oil shale retorts in a row of retort sites in a subterranean formation containing oil shale, each such retort comprising top, bottom and side boundaries of unfragmented formation and containing a fragmented permeable mass of formation particles containing oil shale, comprising the steps of:

excavating at least one access drift at a first end of the module;

excavating at least one access drift at the second end of the module;

excavating a first cross drift between the access drifts and extending through the retort sites at a lower elevation and along one side boundary of such a retort site;

excavating a second cross drift between the access drifts and including a ramp portion at at least one end of the second cross drift for extending through the retort sites at a higher elevation and along the opposite side boundary of the retort site;

excavating a horizontally extending slice extending substantially to the side boundaries of such a retort site at the elevation of the second cross drift;

benching from the slice to the first drift for forming a void extending between the side boundaries and leaving at least one zone of unfragmented formation remaining in the retort site and having a horizontally extending free face adjacent to the void; and explosively expanding such a zone of formation toward the free face for forming a fragmented permeable mass of formation particles containing oil shale in the retort.

17. A method for forming an in situ oil shale retort in a subterranean formation containing oil shale, the retort comprising top, bottom, and side boundaries of unfragmented formation and containing a fragmented permeable mass of formation particles containing oil shale comprising the steps of:

excavating at least one horizontally extending void within the side boundaries of the retort site and leaving a remaining zone of unfragmented formation in the retort site having a horizontally extending free face adjacent to such a void by the steps of:

excavating a first drift adjacent to the floor of the void through first and second opposite side boundaries, and along a third side boundary, excavating a second drift adjacent to the roof of the void through the first and second side boundaries and along a fourth side boundary opposite the third side boundary;

excavating a minor portion of formation as a horizontally extending slice for forming an upper portion of the void adjacent to the roof of the void and leaving a major portion of formation between the upper portion of the void and the floor of the void being formed;

establishing communication between the upper portion of the void and the lower level drift for forming a vertically extending free face;

drilling vertically extending blastholes in the major portion of the formation and parallel to the free face;

placing explosive charges in such blastholes and detonating such explosive charges for explosively expanding formation between such blastholes and the free face toward the free face; and removing such explosively expanding formation via the lower level drift; and explosively expanding such a remaining zone of unfragmented formation toward the void for forming a fragmented permeable mass of formation particles in an in situ oil shale retort.

* * * * *

UNITED STATES PATENT AND TRADEMARK OFFICE

CERTIFICATE OF CORRECTION

PATENT NO. : 4,440,446

DATED : April 3, 1984

INVENTOR(S) : Ned M. Hutchins

It is certified that error appears in the above-identified patent and that said Letters Patent is hereby corrected as shown below:

Column 1, line 11, "Descriptiposits" should be deleted and the following should be inserted -- Description of the Prior Art. The presence of large deposits of oil shale in the semi-arid high plateau region of the Western United States has given rise to extensive efforts to develop methods for recovering shale oil from kerogen in the oil shale deposits. --

Column 2, line 27, "rowe" should be -- rows --.

Column 3, line 42, a period should be inserted after "retorts" and before "FIGS."

Signed and Sealed this

Sixteenth Day of October 1984

[SEAL]

*Attest:*

GERALD J. MOSSINGHOFF

*Attesting Officer*

*Commissioner of Patents and Trademarks*